US005676428A

United States Patent [19]

St. Laurent

[11] Patent Number: 5,676,428

[45] Date of Patent: Oct. 14, 1997

[54] WHEEL ASSEMBLY FOR IN-LINE SKATE

[75] Inventor: Clement St. Laurent, St.-Ours, Canada

[73] Assignee: 9035-0687 Quebec Inc., Mt. Royal, Canada

[21] Appl. No.: 668,679

[22] Filed: Jun. 24, 1996

[51] Int. Cl.[6] ..... A63C 17/04

[52] U.S. Cl. ..... 301/5.3; 280/11.22

[58] Field of Search ..... 301/5.3, 5.7; 280/11.19, 280/11.22, 11.23

[56] References Cited

U.S. PATENT DOCUMENTS

| | | | |
|---|---|---|---|
| 282,156 | 7/1883 | Burton . | |
| 320,774 | 6/1885 | Gardner . | |
| 1,687,113 | 10/1928 | Stockdale . | |
| 2,145,219 | 1/1939 | Burton | 280/11.22 |
| 2,570,349 | 10/1951 | Kardhordo | 280/11.22 |
| 4,603,868 | 8/1986 | Schutz | 280/11.22 X |
| 5,129,709 | 7/1992 | Klamer . | |
| 5,310,250 | 5/1994 | Gonsior . | |
| 5,312,165 | 5/1994 | Spletter . | |
| 5,382,031 | 1/1995 | Marconato et al. . | |
| 5,401,037 | 3/1995 | O'Donnell . | |
| 5,470,086 | 11/1995 | Peterson et al. | 301/5.7 X |
| 5,573,309 | 11/1996 | Bekessy | 280/11.23 X |
| 5,588,658 | 12/1996 | Perner et al. | 280/11.22 |

FOREIGN PATENT DOCUMENTS

| | | | |
|---|---|---|---|
| 2178967 | 2/1987 | United Kingdom | 280/11.23 |

*Primary Examiner*—Russell D. Stormer
*Attorney, Agent, or Firm*—George A. Seaby

[57] ABSTRACT

In general, in-line roller skates include a plurality of rollers or wheels mounted in a support on the bottom of a pair of boots. Because of friction between the wheels and the ground, such roller skates do not operate as smoothly as ice skates. The difference is quite noticeable during turning. The problem of smooth turning on in-line skates is solved by a wheel assembly including a pair of end wheels with tapered peripheries, and a pair of intermediate wheels at least the rearmost of which defines a pivot wheel. The pivot wheel is less tapered than the end wheels, i.e. in cross section the outer periphery of the pivot wheel defines a semicircle. When the wheel assembly is used on a pair of skates, during turning, only the pivot wheel and possibly the other intermediate wheel contacts the ground. Thus, friction is reduced, and the result more closely resembles the feel of ice skates.

6 Claims, 2 Drawing Sheets

WHEEL ASSEMBLY FOR IN-LINE SKATE

BACKGROUND OF THE INVENTION

1. Field of the Invention

This invention relates to a wheel assembly, and in particular to a wheel assembly for in-line skates.

2. Discussion of the Prior Art

During the last few years, in-line skates have become quite popular. Such skates include a boot of the type used in ice skates, a frame or support mounted on the sole of the boot, and a set of narrow wheels aligned with the longitudinal axis of the boot. When skating using currently available skates all of the wheels of a skate contact the ground simultaneously. It has been found that the friction between the rollers and the ground, particularly during turning acts as an impediment. Ideally, the skates should simulate ice skates as much as possible in terms of the ability to make turns with the least amount of effort.

The patent literature describes in-line skates and rollers which can be used on such skates. The literature in question includes U.S. Pat. Nos. 282,156, which issued to George D. Burton on Jul. 31, 1883; 320,774, which issued to W. Gardner on Jun. 23, 1885; 1,687,113, which issued to W. A. Stockdale on Oct. 9, 1928; 5,129,709, which issued to R. Klamer on Jul. 14, 1992; 5,310,250, which issued to S. W. Gonsior on May 10, 1994; 5,312,165, which issued to G. J. Spletter on May 17, 1994; 5,382,031, which issued to L. Marconato et al on Jan. 17, 1995 and 5,401,037, which issued to P. J. O'Donnell on Mar. 28, 1995. Of these patents, the only one addressing the question of improved turning is the Marconato et al patent which describes skates resembling conventional in-line skates, except that the intermediate wheels are not aligned with the front and rear wheels. Spacers are used to maintain the wheels in the proper position in a support. Such a structure is somewhat complicated, and requires additional elements (the spacers) when assembling the skate.

GENERAL DESCRIPTION OF THE INVENTION

The object of the present invention is to provide a wheel assembly for an in-line skate which facilitates turning, even when making a tight turn.

Another object of the invention is to provide a wheel assembly kit, which can be used to retrofit existing in-line skates.

Accordingly, the present invention relates to a wheel assembly for an in-line roller skate, which includes an article of footwear and a wheel support; the wheel assembly comprising a plurality of circular wheels for mounting in a wheel support, said wheels having the same overall diameter and including a pair of end wheels and at least one intermediate wheel, each of said wheels including an outer contact surface bordered by side contact surfaces, at least one said intermediate wheel being a pivot wheel having side contact surfaces protruding beyond the side contact surfaces of said end wheel and having smaller radii of curvature than the side contact surfaces of said end wheels.

The invention also provides a wheel assembly kit for use on an in-line roller skate comprising a plurality of circular wheels, each said wheel having the same overall diameter and including a pair of end wheels and at least one intermediate wheel, each of said wheels including an outer contact surface bordered by side contact surfaces, at least one said intermediate wheel being a pivot wheel having side contact surfaces protruding beyond the side contact surfaces of said end wheels and having smaller radii of curvature than the side contact surfaces of said end wheels.

BRIEF DESCRIPTION OF THE DRAWINGS

The invention is described hereinafter in greater detail with reference to the accompanying drawings which illustrate a preferred embodiment of the invention and wherein.

DESCRIPTION OF THE PREFERRED EMBODIMENT

Figure 1:
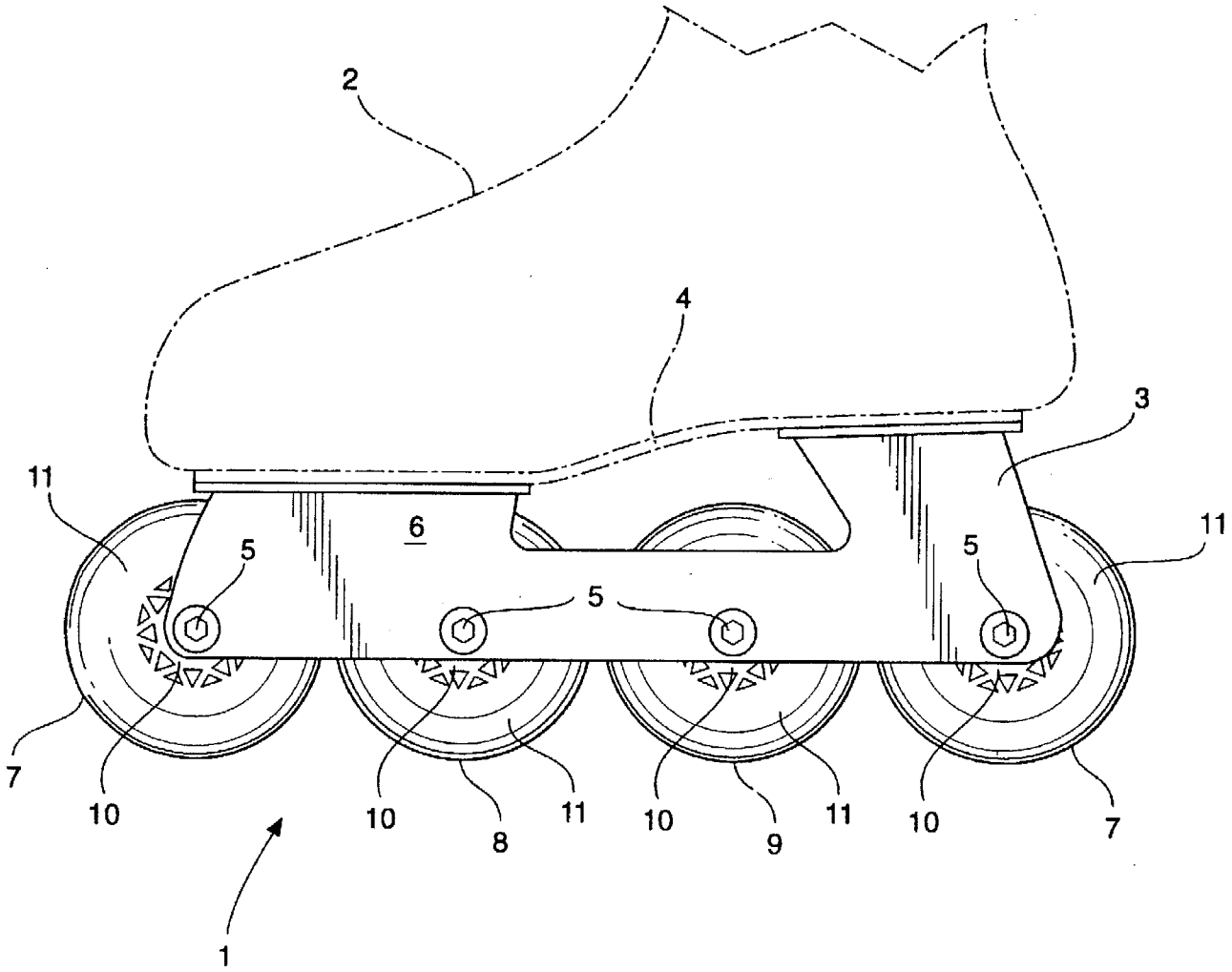
FIG. 1 is a schematic side view of an in-line skate incorporating a wheel assembly in accordance with the present invention.

Referring to FIG. 1, the wheel assembly of the present invention, which is generally indicated at 1 is intended for use on a conventional in-line skate. The skate includes a boot 2 or other article of footwear. A wheel support in the form of a bracket 3 of generally inverted U-shaped cross section is mounted on the sole 4 of the boot 2. Axles 5 extend between the sides 6 (one shown) of the bracket 3 for rotatably supporting a plurality of circular, i.e. disc-shaped wheels, including end wheels 7 and intermediate wheels 8 and 9.

All of the wheels 7, 8 and 9 are of the same overall diameter, and include a body defined by a hub 10 (FIG. 1) for receiving an axle 5, and an annular rim 11 integral with the hub 10. The outer periphery of the rim 11 of each of the wheels 7, 8 and 9 is arcuate or rounded in cross section for limiting the area of the wheel which is in contact with the ground at any time. By limiting the contact surface, friction between the wheels and the ground is reduced and consequently the wheels rotate or roll more smoothly.

Figure 2:
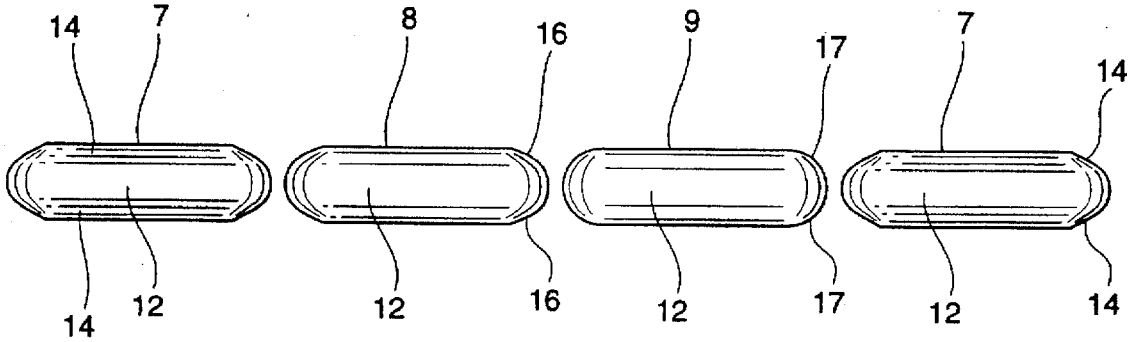
FIG. 2 is a bottom view of the wheels used in the assembly of FIG. 1.

With reference to FIG. 2, the rim of each of the wheels 7 includes an outer contact surface 12, which is normally in contact with the ground when the wheels are vertically oriented, e.g. when the skater is coasting on the skate and during turning. The lateral dimension of the contact surface 12 is quite small, and the areas 14 on each side of the surface 12 do not contact the ground during skating. By using such outwardly tapering wheels with small contact surfaces, friction between the ground and the rollers is reduced to make skating easier. In accordance with the present invention, the wheels 7 at the front and rear of the wheel assembly have outer peripheries which are more tapered than the outer peripheries of the remaining or intermediate wheels 8 and 9.

As best shown in FIG. 2, in terms of geometry, the side areas 14 (hereinafter referred to as contact surfaces 14) on the outer peripheries of the front and rear wheels 7 are straight or slightly convex. Thus, each such contact surface 14 has a relatively large radius of curvature, which in the case of a straight surface approaches infinity. Each side contact surfaces 16 of the second wheel 8 from the front of the wheel assembly has a smaller radius of curvature, i.e. the outer periphery of the wheel 8 comes closer to defining a semicircle when viewed in cross section than the corresponding area of the wheel 7. The same is true of the side contact surfaces 17 of the third wheel 9 from the front (the second wheel from the rear) of the wheel assembly. Thus, the third wheel 9, which is located approximately beneath the ankle of the skater when the skate is in use, has an outer periphery, opposed sides of which are approximately semi-circular in cross section. The wheel 9 has side contact surfaces 17, which have radii of curvature which are even smaller than the radii of curvature of the side contact surfaces 16 of the wheel 8.

Figure 3:
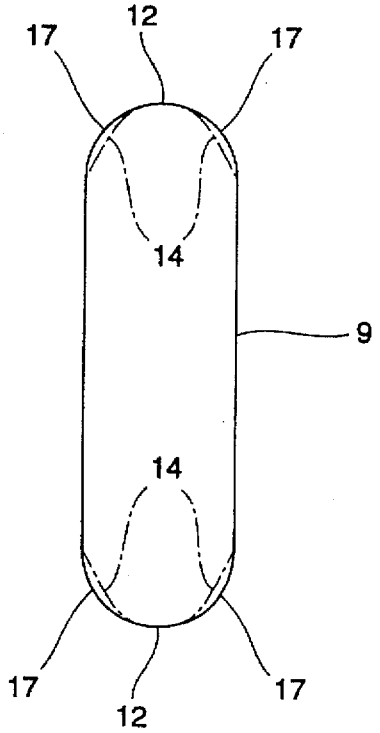
FIG. 3 is a schematic end view of two of the wheels used in the assembly of FIG. 1.

The difference between the radii of curvature of the side contact surfaces 14 of each of the wheels 7 and of the side contact surfaces 17 of the wheel 9 is illustrated in FIG. 3. It will be noted that, in effect, the side contact surfaces 17 of the wheel 9 extend outwardly or protrude beyond the side contact surfaces 14 of the wheels 7 and (while not shown in FIG. 3) slightly beyond the side contact surfaces of the wheel 8.

Referring again to FIG. 1, during normal skating or when coasting with the wheels 7, 8 and 9 in a more or less vertical or slightly inclined plane, the outer contact surfaces are of all skates normally in contact with the ground when the skate is down. When turning, particularly in a tight turn, the side contact surfaces 14 of the wheels 7 do not contact the ground. Only the contact surfaces 16 and 17 of the wheels 8 and 9 contact the ground. In a tight turn, the contact surfaces 16 of the wheel 8 can also lose contact with the ground. At the very least contact between the ground and the front and/or rear wheels is substantially reduced depending on the orientation of the skater, i.e. whether the skater is standing up straight, bent forward, or even leaning slightly back on the skates. The result of reduced contact with the ground is that the wheel assembly approximates the feel of ice skates making turning smoother and easier for the skater.

While the above description relates to a conventional four wheel skate, it will be appreciated that the basic concept can be employed with a child's three wheel skate or even with a skate having five or more wheels. By utilizing at least one intermediate wheel with protruding side contact areas, at some point during turning the number of wheels in contact with the ground is reduced.

Because it is relatively easy to replace the wheels on in-line skates, the wheels can form a kit for retrofitting existing skates. When used in kit form, it is preferable that the wheels be numbered or color coded, particularly when there are small differences in shape.

I claim:

1. A wheel assembly for an in-line roller skate, which includes an article of footwear and a wheel support; the wheel assembly comprising a plurality of circular wheels for mounting in a wheel support, said wheels having the same overall diameter and including a pair of end wheels and at least one intermediate wheel, each of said wheels including an outer contact surface bordered by side contact surfaces, and at least one said intermediate wheel being a pivot wheel having side contact surfaces protruding beyond the side contact surfaces of said end wheels and having smaller radii of curvature than the side contact surfaces of said end wheels.

2. The wheel assembly of claim 1, wherein said pivot wheel is located approximately beneath the ankle portion of a skate when the wheels are mounted in a wheel support.

3. The wheel assembly of claim 2 including a pair of intermediate wheels, said pivot wheel being the rearmost of the intermediate wheels when the wheels are mounted in a wheel support.

4. The wheel assembly of claim 3, wherein the other said intermediate wheel includes side contact surfaces with a radii of curvature intermediate the radii of curvature of the side contact surfaces of said end and pivot wheels.

5. A wheel assembly kit for use on an in-line roller skate comprising a plurality of circular wheels, each said wheel having the same overall diameter and including a pair of end wheels and at least one intermediate wheel, each of said wheels including an outer contact surface bordered by side contact surfaces, and at least one said intermediate wheel being a pivot wheel having side contact surfaces with a smaller radius of curvature than the side contact surfaces of said end wheels.

6. The wheel assembly kit of claim 5, including a pair of intermediate wheels including said pivot wheel and a second intermediate wheel, said second intermediate wheel having side contact surfaces with a radii of curvature intermediate the radii of curvature of the side contact surfaces of said end and pivot wheels.

* * * * *